US006581526B2

(12) United States Patent
Theurer et al.

(10) Patent No.: US 6,581,526 B2
(45) Date of Patent: Jun. 24, 2003

(54) APPARATUS FOR STRIPPING BALLAST FROM TIES OF A TRACK

(75) Inventors: Josef Theurer, Vienna (AT); Friedrich Peitl, Linz (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/098,918

(22) Filed: Mar. 15, 2002

(65) Prior Publication Data

US 2002/0148379 A1 Oct. 17, 2002

(30) Foreign Application Priority Data

Apr. 17, 2001 (AU) ..... 298/2001

(51) Int. Cl.[7] ..... E01H 8/00
(52) U.S. Cl. ..... 104/279; 15/54; 104/2
(58) Field of Search ..... 104/2, 7.3, 279; 15/54, 55

(56) References Cited

FOREIGN PATENT DOCUMENTS

| | | |
|---|---|---|
| GB | 2 205 882 | 5/1991 |
| GB | 2 241 271 | 1/1994 |

*Primary Examiner*—Mark T. Le
(74) *Attorney, Agent, or Firm*—Henry M. Feiereisen

(57) ABSTRACT

A stripping apparatus is associated with a track maintenance machine having a machine frame mobile on a track comprised of rails fastened to ties. The stripping apparatus is designed for stripping off ballast lying on the ties and includes a supporting beam, which is mounted for vertical adjustment on the machine frame, and a plurality of elastic sweeping elements, which are disposed in a substantially vertical position. The sweeping elements are fastened at their upper ends to the supporting beam and are arranged adjacent to one another in a sweeping plane extending perpendicularly to the direction of longitudinal extension of the track. Two support rollers fastened to the supporting beam are provided for riding on the rails of the track.

19 Claims, 2 Drawing Sheets

Fig.2
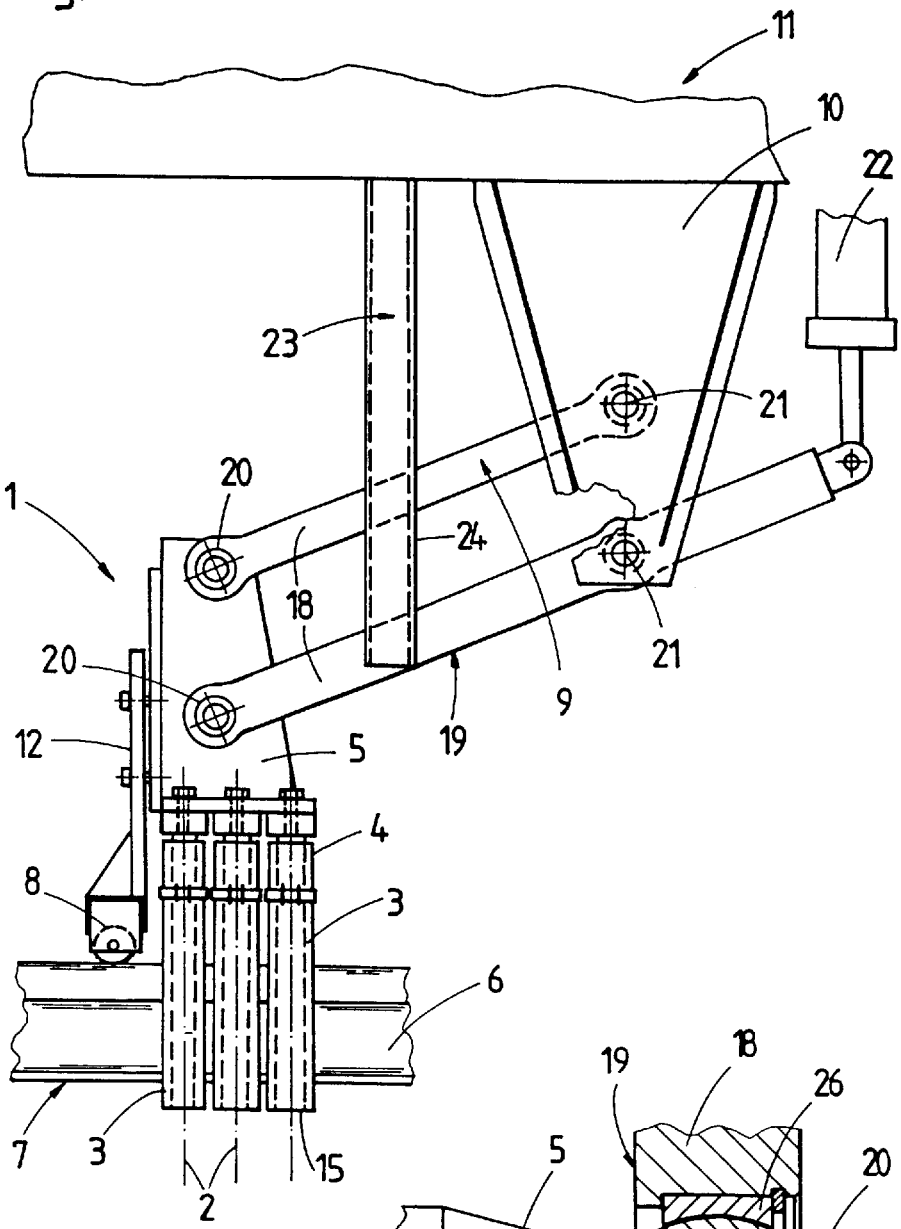
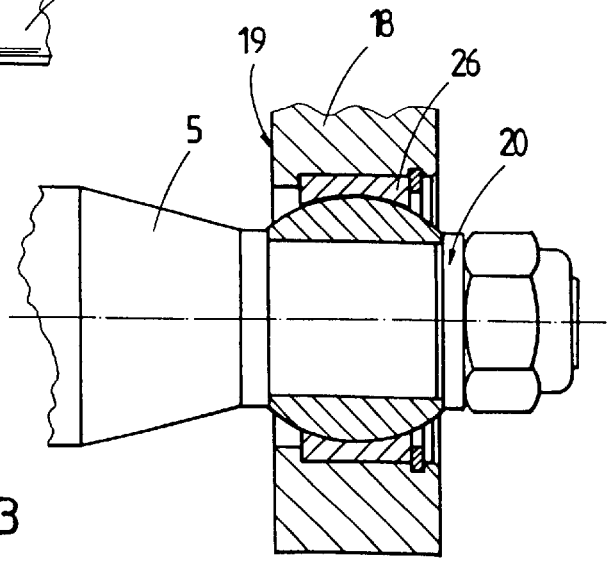
Fig.3

APPARATUS FOR STRIPPING BALLAST FROM TIES OF A TRACK

CROSS-REFERENCES TO RELATED APPLICATIONS

This application claims the priority of Austrian utility model no. GM 298/2001, filed Apr. 17, 2001, the subject matter of which is incorporated herein by reference.

BACKGROUND OF THE INVENTION

The present invention relates, in general, to a stripping apparatus for a track maintenance machine, and more particularly to a stripping apparatus of a type having sweeping elements for stripping off ballast from ties of a track comprised of rails which are fastened to the ties.

Stripping apparatuses of this kind are known in connection with ballast ploughs, for example from British Pat. No. GB 2 241 271, and are designed in the shape of cylindrical sweeping brushes which rotate about a brush shaft, extending parallel to the longitudinal direction of the ties of the track, to sweep off ballast lying on top of the ties. Such sweeping brushes are especially suited for moving greater amounts of ballast while optimally profiling the ballast bed.

British Pat. No. GB 2 205 882 describes the arrangement of a small rotatable sweeping brush at a free end of a shoulder plough in order to shape also a lower end region of a ballast bed shoulder.

It would be desirable and advantageous to provide an improved stripping apparatus of the afore-described type, which obviates prior art shortcomings and is able to sweep off even relatively small amounts of ballast in a reliable manner and yet is simple in structure.

SUMMARY OF THE INVENTION

According to one aspect of the present invention, a stripping apparatus includes a supporting beam mounted for vertical adjustment on the machine frame; a plurality of elastic sweeping elements disposed in a substantially vertical position and having an upper end, wherein the sweeping elements are fastened at their upper ends to the supporting beam and arranged adjacent to one another in a sweeping plane; and two support rollers fastened to the supporting beam and intended for travelling on the rails of the track.

A stripping apparatus according to the invention is designed in a relatively simple fashion, and allows a displacement of ballast into an adjoining tie crib in a reliable way while at the same time rendering unnecessary a rotational movement of the sweeping elements which would not only complicate the structure but also cause increased wear and tear of the sweeping elements. Furthermore, the provision of the support rollers, which are connected to the supporting beam, ensures also a constant distance of the lower ends of the sweeping elements from the upper surface of the ties.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 2 is a side elevation of the stripping device, as viewed transversely to the track; and FIG. 3 is a cross sectional view, on an enlarged scale, of a detail of the stripping apparatus, taken along the line III—III in FIG. 1 and depicting a jointed connection of a carrying frame to a supporting beam of the stripping apparatus.

DETAILED DESCRIPTION OF PREFERRED EMBODIMENTS

Figure 1:
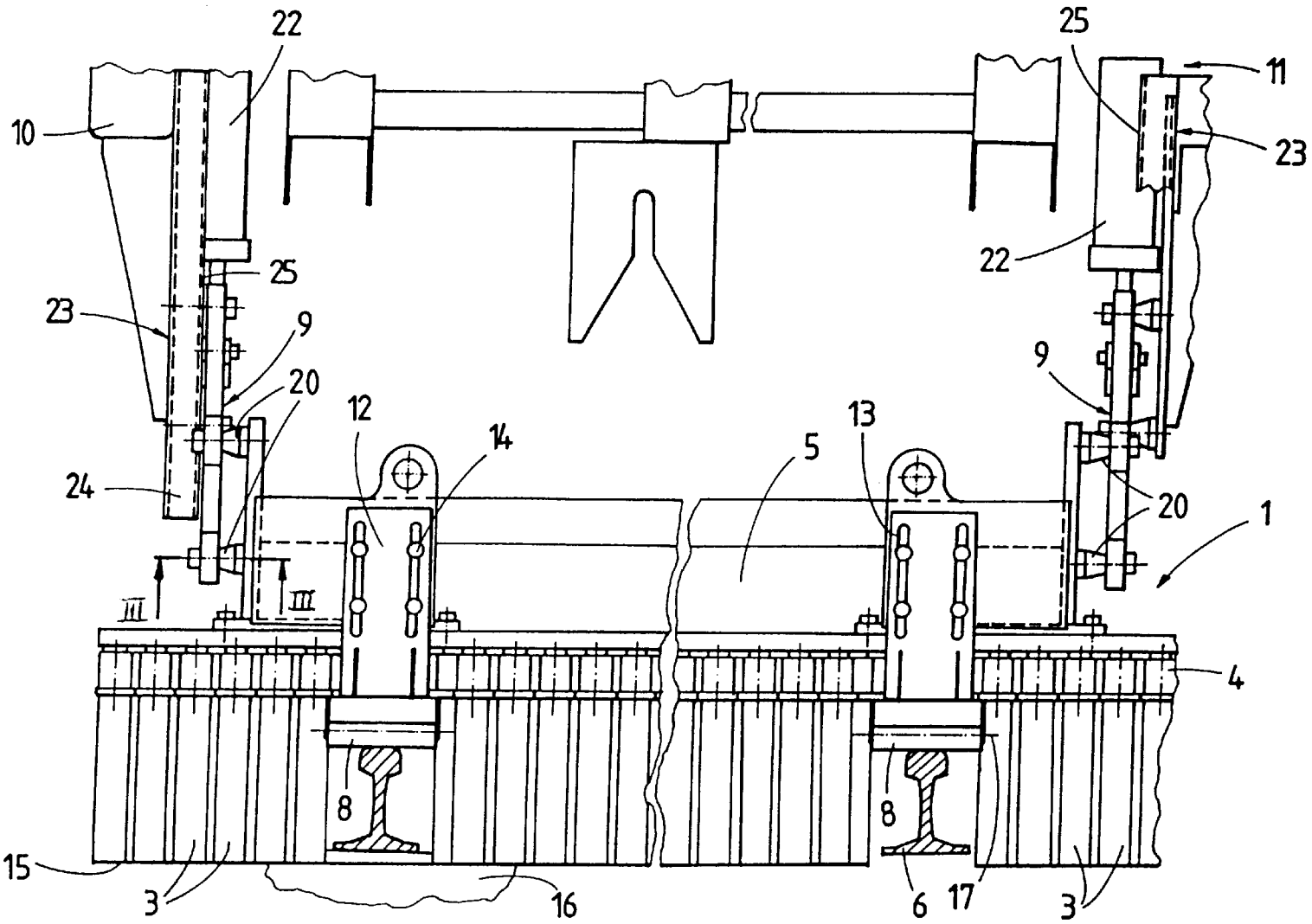
FIG. 1 is a simplified illustration of one embodiment of a stripping apparatus according to the present invention, as viewed longitudinally in the direction of the track.

Throughout all the Figures, same or corresponding elements are generally indicated by same reference numerals.

Turning now to the drawing, and in particular to FIGS. 1 and 2, there are shown a stripping apparatus 1 mounted on a machine frame 10 of a track maintenance machine 11 (not shown in detail). The track maintenance machine 11 is mobile on a track 7 comprised of rails 6 and ties 16, with the machine frame 10 extending along the track in a longitudinal direction. The stripping apparatus 1 includes a number of elastic sweeping elements 3 which are positioned adjacent to one another and arranged in sweeping planes 2 extending at an angle to the longitudinal direction, preferably perpendicularly to the longitudinal direction. In the exemplified embodiment shown in FIG. 1, three sweeping planes 2 are used, one immediately following the other in the longitudinal direction. The sweeping elements 3 are cylindrical in shape and have an upper end 4 for securement to an elongated supporting beam 5.

The supporting beam 5 is equipped with two support rollers 8 for supporting the supporting beam 5 on the rails 6 of the track 7. Each support roller 8 is adjustable in a vertical direction relative to the supporting beam 5 by means of an adjustment device 12 which, in the illustrated embodiment, is composed of vertical guides 13 and bolts 14. Thus it is possible to vary the distance between lower ends 15 of the sweeping elements 3 and the ties 16 of the track 7, as desired. Each cylindrical support roller 8 is mounted on the supporting beam 5 for rotation about an axis 17 and has a length of at least 150 millimeters, preferably 200 millimeters.

Two carrying frames 9, spaced from one another transversely to the longitudinal direction, are provided for articulatedly connecting the supporting beam 5 to the machine frame 11. Each carrying frame 9 includes a parallelogram linkage 19 having two arms 18 and articulatedly connected to the supporting beam 5 by two joints 20. Drives 22 are provided for vertically adjusting the carrying frames 9, pivotably mounted to the machine frame 10 for rotation about a horizontal axis 21, which extends perpendicularly to the longitudinal direction. As a consequence, the supporting beam 5 is also adjusted in the vertical direction.

Associated with the two carrying frames 9 is a centering device 23, which is connected to the machine frame 10. The centering device 23 includes two centering braces 24, spaced from one another in the direction of longitudinal extension of the support beam 5 with respect to the sweeping plane 2 and extending in a vertical direction, whereby each brace 24 defines a vertical centering plane 25. The carrying frames 9 are arranged between the centering braces 24 so that the articulatedly mounted stripping apparatus 1 is reliably prevented from slipping off the rails 6 in a lateral direction, even if the track 7 is inclined in the transverse direction.

As shown in FIG. 3, the joint 20 includes a ball pivot 26 which allows a universally effective flexibility or movement between the parallelogram linkage 19 and the supporting beam 5.

While the invention has been illustrated and described as embodied in an apparatus for stripping ballast from ties of a track, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents.

What is claimed is:

1. A stripping apparatus for a track maintenance machine having a machine frame mobile on a track comprised of rails fastened to ties, the stripping apparatus being designed for stripping off ballast lying on the ties and comprising (a) a supporting beam mounted for vertical adjustment on the machine frame;

(b) a plurality of elastic sweeping elements disposed in a substantially vertical position and having an upper end, the sweeping elements being fastened at their upper ends to the supporting beam and being arranged adjacent to one another in a sweeping plane; and (c) two support rollers fastened to the supporting beam and intended for riding on the rails of the track.

2. The stripping apparatus of claim 1, wherein the sweeping elements are arranged in at least two sweeping planes positioned one immediately following the other in the direction of longitudinal extension of the track, and wherein the sweeping elements of the one sweeping plane are staggered with respect to the sweeping elements of the other sweeping plane.

3. The stripping apparatus of claim 1, and further comprising an adjustment device for vertically adjusting the support rollers relative to the supporting beam.

4. The stripping apparatus of claim 3, wherein the support rollers are of cylindrical shape and have a length of at least 150 millimeters.

5. The stripping apparatus of claim 1, and further comprising two carrying frames spaced from one another in the direction of longitudinal extension of the supporting beam and mounted to the machine frame for vertical adjustment by means of a drive, the supporting beam being articulatedly connected to the carrying frames by means of joints.

6. The stripping apparatus of claim 5, wherein each carrying frame is mounted on the machine frame for pivoting about an axis extending perpendicularly to the longitudinal direction of the track.

7. The stripping apparatus of claim 5, wherein each carrying frame is designed as a parallelogram linkage comprising two arms and two joints for fixation of the supporting beam.

8. The stripping apparatus of claim 5, and further comprising a centering device connected to the machine frame and associated with the carrying frames for guiding the same in a vertical direction.

9. The stripping apparatus of claim 8, wherein the centering device is composed of two vertically disposed centering braces comprising a vertical centering plane, the centering braces being spaced from one another with regard to the sweeping plane, and the carrying frames being positioned between the centering braces.

10. Apparatus for sweeping ballast from ties of a track, comprising:

a supporting beam mounted for vertical adjustment and supported on two rollers for travel along the track in an operating direction;

plural sweeping elements disposed in side-by-side relationship in at least one plane and having an upper end for securement to the supporting beam; and a first adjustment device for vertically adjusting the rollers relative to the supporting beam.

11. The apparatus of claim 10, wherein the sweeping elements are arranged in at least two sweeping planes behind one another in the operating direction and disposed in staggered relationship.

12. The apparatus of claim 10, wherein the rollers have a cylindrical configuration and are defined by a length of at least 150 millimeters.

13. The apparatus of claim 10, and further comprising a second adjustment device for vertically adjusting the supporting beam, wherein the second adjustment device includes a carrying frame having one end joined to the supporting beam and another end, and a drive operatively connected to the other end of the carrying frame.

14. The apparatus of claim 13, wherein the carrying frame a parallelogram linkage on one side of the supporting beam and a parallelogram linkage on an opposite side of the supporting beam.

15. The apparatus of claim 13, wherein the carrying frame is constructed for rotation about an axis extending perpendicular to the track.

16. The apparatus of claim 13, and further comprising a centering device for guiding the carrying frame in a vertical direction, wherein the centering device includes two vertical centering braces in spaced-apart disposition for guiding the carrying frame in-between.

17. A track maintenance machine, comprising:

a machine frame constructed for mobility on a track and defining a longitude axis; and a stripping apparatus for sweeping ballast from ties of the track, wherein the stripping apparatus includes a supporting beam mounted for vertical adjustment and supported on two rollers for travel along the track, plural sweeping elements disposed in side-by-side relationship in at least one plane and having an upper end for securement to the supporting beam, and a first adjustment device for vertically adjusting the rollers relative to the supporting beam.

18. The machine of claim 17, wherein the stripping apparatus includes a second adjustment device for vertically adjusting the supporting beam, said second adjustment device including a carrying frame mounted to the machine frame and having one end jointed to the supporting beam and another end, and a drive operatively connected to the other end of the carrying frame.

19. The machine of claim 18, wherein the carrying frame is constructed for rotation about an axis extending perpendicular to the longitudinal axis.

* * * * *